US010520172B2

(12) United States Patent
Moon et al.

(10) Patent No.: US 10,520,172 B2
(45) Date of Patent: Dec. 31, 2019

(54) RECESSED LIGHTING FIXTURE AND METHOD OF INSTALLING LED LAMPS THEREIN

(71) Applicant: Sang Pil Moon, Seoul (KR)

(72) Inventors: Dai Sung Moon, Seoul (KR); Sang Pil Moon, Seoul (KR)

(73) Assignee: Sang Pil Moon, Seoul (KR)

( * ) Notice: Subject to any disclaimer, the term of this patent is extended or adjusted under 35 U.S.C. 154(b) by 78 days.

(21) Appl. No.: 15/893,560

(22) Filed: Feb. 9, 2018

(65) Prior Publication Data

US 2019/0063731 A1 Feb. 28, 2019

Related U.S. Application Data

(63) Continuation of application No. PCT/CN2017/098961, filed on Aug. 25, 2017.

(51) Int. Cl.

| | |
|---|---|
| ***F21S 8/02*** | (2006.01) |
| ***F21V 21/03*** | (2006.01) |
| ***F21V 17/10*** | (2006.01) |
| ***F21V 19/00*** | (2006.01) |
| *F21Y 115/10* | (2016.01) |
| *F21V 21/04* | (2006.01) |
| *F21Y 105/10* | (2016.01) |

(52) U.S. Cl.

CPC ..... *F21V 21/03* (2013.01); *F21S 8/026* (2013.01); *F21V 17/105* (2013.01); *F21V 19/0015* (2013.01); *F21V 21/04* (2013.01); *F21Y 2105/10* (2016.08); *F21Y 2115/10* (2016.08)

(58) Field of Classification Search

CPC ..... F21S 8/026; F21V 15/01; F21V 15/012; F21V 17/105; F21V 19/0015; F21V 21/03; F21V 21/04; F21Y 2105/10; F21Y 2115/10

See application file for complete search history.

(56) References Cited

U.S. PATENT DOCUMENTS

| | | | | |
|---|---|---|---|---|
| 3,019,333 A * | 1/1962 | Pascucci | ..... | F21S 8/02 220/3.8 |
| 8,272,763 B1 * | 9/2012 | Chinnam | ..... | F21V 29/004 362/147 |
| 8,727,566 B1 * | 5/2014 | Szeto | ..... | F21S 8/026 29/825 |
| 9,279,553 B1 * | 3/2016 | Scribante | ..... | F21S 8/026 |

(Continued)

FOREIGN PATENT DOCUMENTS

| | | |
|---|---|---|
| CN | 203810158 U | 9/2014 |
| CN | 204387768 U | 6/2015 |
| CN | 206191424 U | 5/2017 |

*Primary Examiner* — Zheng Song

(57) ABSTRACT

Disclosed is a recessed lighting fixture having a housing (1), wherein an edge at an open end of the housing (1) extends horizontally and outwardly and then bends perpendicularly and downwardly to form a first chamber (2) having a rectangular cross section, a bottom of the perpendicular edge extends horizontally and outwardly and then bends perpendicularly and upwardly to form a tray (21) having a rectangular cross section, a mounting element (3) is fixed to a bottom of the first chamber (2), the mounting element (3) has a first mounting room (31) for receiving an LED lamp (4), and a magnetic body (5) for attracting and positioning the LED lamp (4).

4 Claims, 3 Drawing Sheets

(56) References Cited

U.S. PATENT DOCUMENTS

| | | | | |
|---|---|---|---|---|
| 2013/0027916 | A1* | 1/2013 | Caferro | F21V 29/004 362/147 |
| 2018/0073687 | A1* | 3/2018 | Musser | F21K 9/275 |
| 2018/0156399 | A1* | 6/2018 | Sorensen | F21V 19/001 |
| 2018/0195673 | A1* | 7/2018 | Goelz | F21V 14/04 |

* cited by examiner

RECESSED LIGHTING FIXTURE AND METHOD OF INSTALLING LED LAMPS THEREIN

CROSS-REFERENCE TO RELATED APPLICATIONS

The present application is a Continuation Application of PCT application No. PCT/CN2017/098961 filed on Aug. 25, 2017, the contents of the above are hereby incorporated by reference.

FIELD OF THE INVENTION

The present invention relates to a recessed lighting fixture and a method of installing an LED lamp therein.

BACKGROUND OF THE INVENTION

Conventional recessed lighting fixtures with fluorescent lamps 7 as shown in FIG. 2 are still used in plenty work places nowadays. However, fluorescent lamps 7 have low luminous efficacy, and are not as energy saving and environmentally friendly as LED lamps. If customers want to replace fluorescent lamps with LED lamps in an existing recessed lighting fixture, they need to remove the whole recessed lighting fixture and fluorescent lamps from a ceiling, which consumes a lot of money, manpower and makes customers feel burdened.

The present invention aims at providing a novel recessed lighting fixture, the recessed lighting fixture can be mounted with reflector panels to install fluorescent lamps. When an installer intends to replace the fluorescent lamps with LED lamps, it only requires mounting the LED lamps after removing the reflector panels and fluorescent lamps from the recessed lighting fixture. The present invention also provides a method for installing LED lamps in the recessed lighting fixture.

SUMMARY OF THE INVENTION

The technical solution of the present application is a recessed lighting fixture comprising a housing (1), wherein an edge at an open end of the housing (1) extends horizontally and outwardly and then bends perpendicularly and downwardly to form a first chamber (2) having a rectangular cross section, a bottom of the perpendicular edge extends horizontally and outwardly and then bends perpendicularly and upwardly to form a tray (21) having a rectangular cross section, a mounting element (3) is fixed to a bottom of the first chamber (2), the mounting element (3) has a first mounting room (31) for receiving an LED lamp (4), and a magnetic body (5) for attracting and positioning the LED lamp (4).

Preferably, an inner wall of the housing (1) is provided with a hook holder (11), which is corresponding to a hook (42) provided at an end of a sling (41) provided on a wall of the LED lamp (4); the LED lamp (4) is connected to the housing (1) through the hook (42) being caught in the hook holder (11).

Preferably, the mounting element (3) is consisted of: an U-shaped body (32); a vertical wall (33), the vertical wall (33) running parallel with a side wall (321) of the U-shaped body (32) and being connected with the side wall (321) through a horizontal wall (36); and a cantilever (34), the cantilever (34) being formed at a bottom end of the vertical wall (33) and consisted of an outwardly-extending portion and an inwardly-extending potion, wherein the outwardly-extending portion of the cantilever (34) covers a portion of a bottom surface of the tray (21), the inwardly-extending potion of the cantilever (34) runs parallel with a bottom wall of the U-shaped body (32) and has a plurality of upwardly-and-perpendicularly positioned gripper jaws (341). The first mounting room (31) for receiving the LED lamp (4) is formed between the bottom wall of the U-shaped body (32) and the gripper jaws (341). A second mounting room (35) for receiving an aluminum substrate (8) having LED bulbs (81) thereon is a space defined among the vertical wall (33), the horizontal wall (36) and the inwardly-extending potion of the cantilever (34).

Preferably, the U-shaped body (32) has the magnetic body (5) therein.

Another technical solution of the present application is a method of replacing fluorescent lamps with LED lamps in the recessed lighting fixture, comprising: removing reflector panels (6) and fluorescent lamps (7) from the recessed lighting fixture; connecting a hook (42) of a sling (41) provided on a wall of the LED lamp (4) to a hook holder (11) of the housing (1); finishing electrical connections as required; and pushing the LED lamp (4) into the first mounting room (31), the LED lamp (4) is thus positioned when it is attracted to the magnetic body (5) located in the mounting element (3).

The beneficial effects of the present invention are as follows. Firstly, the way of connecting the LED lamp to the housing through the hook being caught in the hook holder mounts to a solid connection, which not only reduces installation procedures but also saves costs and time, and ultimately improves efficiency. Secondly, the mounting element has the magnetic body for attracting and positioning the LED lamp, which ensures the LED lamp to be fixedly positioned due to the magnetic attraction and provides a safer installation.

LIST OF REFERENCE NUMERALS

Figure 1:
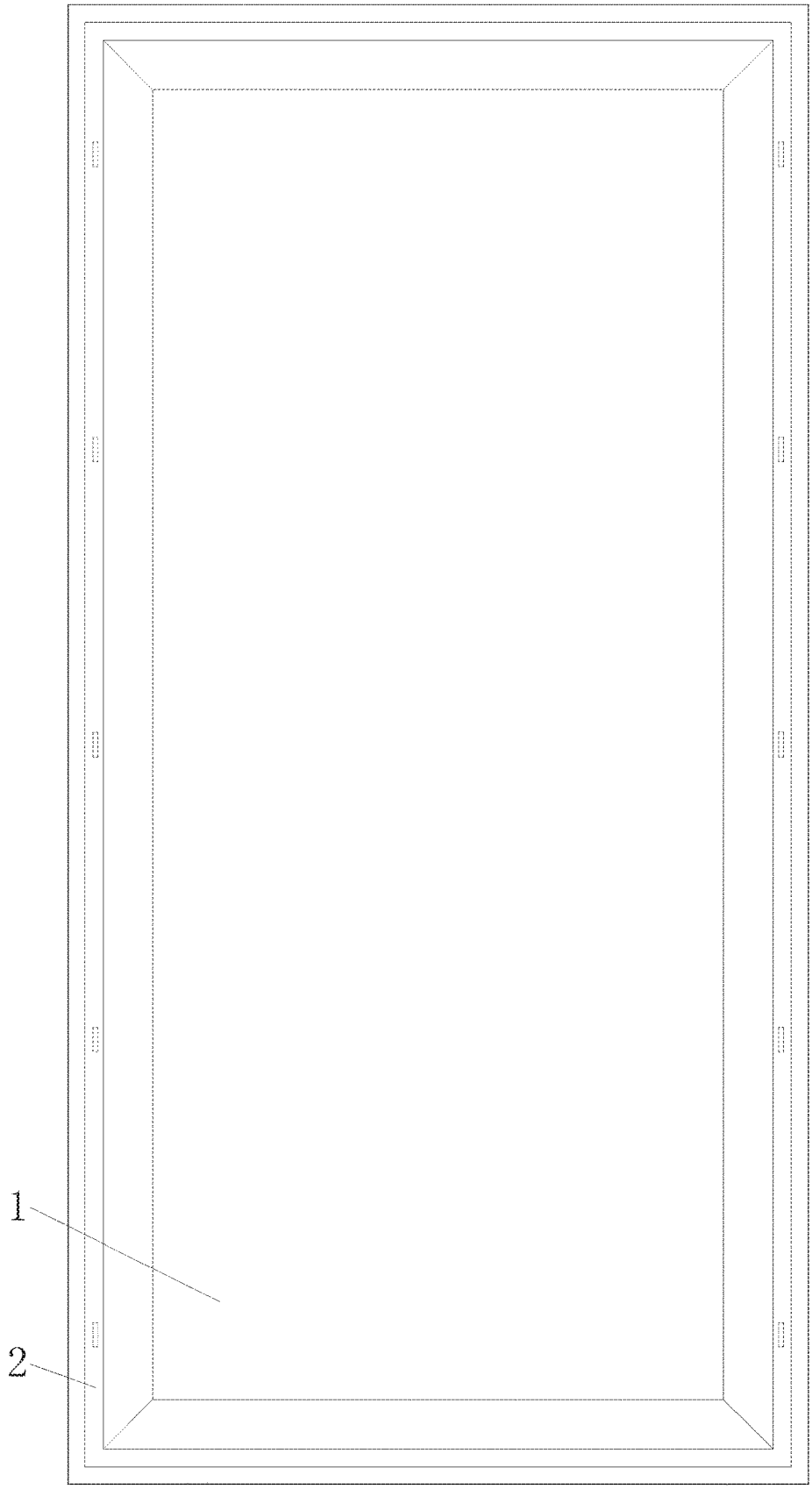
FIG. 1 is a top plan view of a recessed lighting fixture of the present invention.
Figure 2:
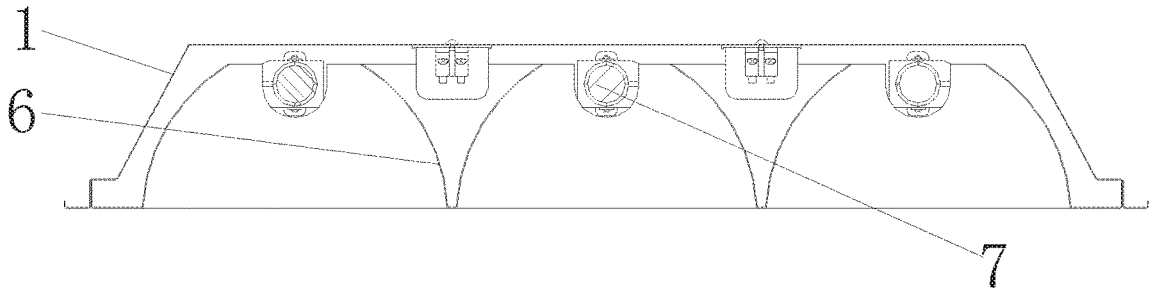
FIG. 2 PRIOR ART
FIG. 2 is a cross-sectional view of an existing recessed lighting fixture having reflector panels and fluorescent lamps.

1. housing
11. hook holder
2. first chamber having a rectangular cross section
21. tray having a rectangular cross section
3. mounting element
31. first mounting room
32. U-shaped body
321. side wall
322. chamber
33. vertical wall
34. cantilever
341. gripper jaw
35. second mounting room
36. horizontal wall
4. LED lamp
41. sling

42. hook
5. magnetic body
6. reflector panel
7. fluorescent lamp
8. aluminum substrate
81. LED bulb

DETAILED DESCRIPTION OF ILLUSTRATED EMBODIMENTS

Embodiments of the present invention are further explained clearly as follows in conjunction with figures.

Figure 3:
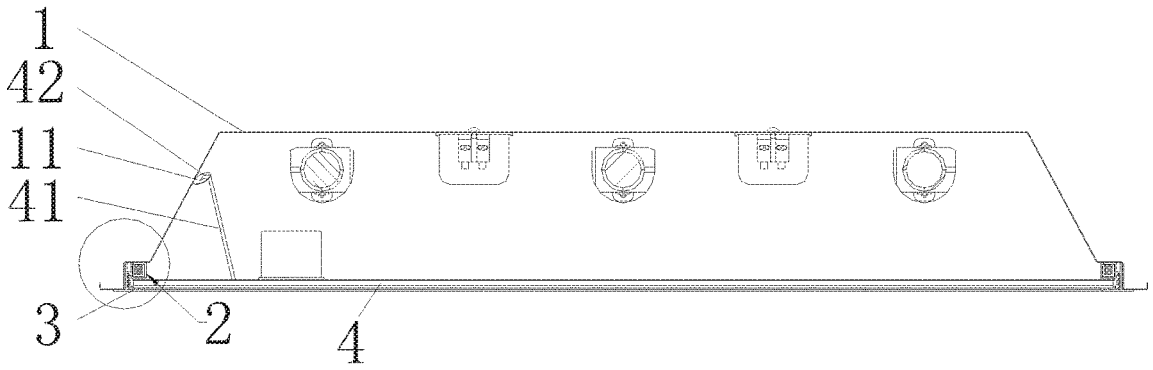
FIG. 3 is a cross-sectional view of a recessed lighting fixture which is able to be mounted with LED lamps.

FIGS. 1 and 3 show a recessed lighting fixture of the present invention, which can be mounted with LED lamps.

Figure 4:
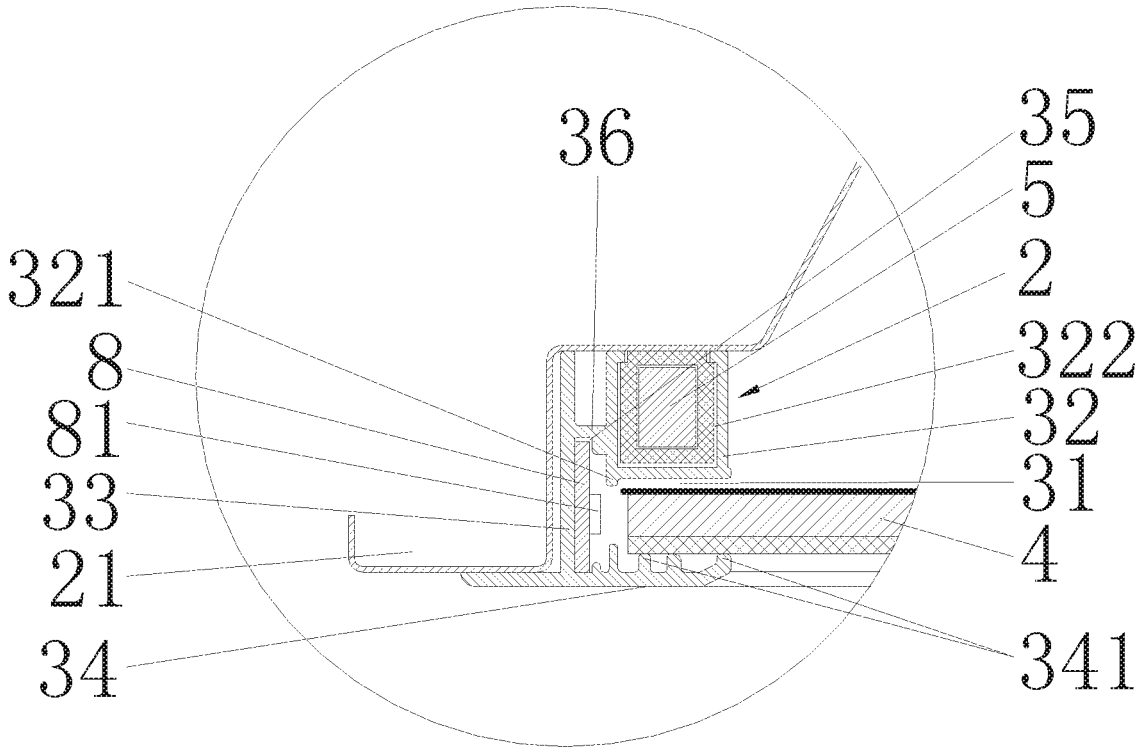
FIG. 4 is an enlarged view of a portion in a circle shown in FIG. 3.

Referring to FIGS. 1, 3 and 4, the recessed lighting fixture comprises a housing 1. An edge at an open end of the housing 1 extends horizontally and outwardly and then bends perpendicularly and downwardly to form a first chamber 2 having a rectangular cross section. A bottom of the perpendicular edge extends horizontally and outwardly and then bends perpendicularly and upwardly to form a tray 21 having a rectangular cross section. A mounting element 3 is fixed to a bottom of the first chamber 2. The mounting element 3 has a first mounting room 31 for receiving an LED lamp 4, and a magnetic body 5 for attracting and positioning the LED lamp 4.

In the present embodiment, an inner wall of the housing 1 is provided with a hook holder 11, which is corresponding to a hook 42 provided at an end of a sling 41 provided on a wall of the LED lamp 4. The LED lamp 4 is connected to the housing 1 through the hook 42 being caught in the hook holder 11.

In the present embodiment, the mounting element 3 is consisted of an U-shaped body 32 having the magnetic body 5 therein; a vertical wall 33, the vertical wall 33 running parallel with a side wall 321 of the U-shaped body 32 and being connected with the side wall 321 through a horizontal wall 36; and a cantilever 34, the cantilever 34 being formed at a bottom end of the vertical wall 33 and consisted of an outwardly-extending portion and an inwardly-extending potion, wherein the outwardly-extending portion of the cantilever 34 covers a portion of a bottom surface of the tray 21, the inwardly-extending potion of the cantilever 34 runs parallel with a bottom wall of the U-shaped body 32 and has a plurality of upwardly-and-perpendicularly positioned gripper jaws 341. The first mounting room 31 for receiving the LED lamp 4 is formed between the bottom wall of the U-shaped body 32 and the gripper jaws 341. A second mounting room 35 for receiving an aluminum substrate 8 having LED bulbs 81 thereon is a space defined among the vertical wall 33, the horizontal wall 36 and the inwardly-extending potion of the cantilever 34.

With reference to FIGS. 1, 3 and 4, a method of replacing fluorescent lamps 7 with LED lamps 4 in the recessed lighting fixture of the present invention comprises the steps of: removing reflector panels 6 and the fluorescent lamps 7 from the recessed lighting fixture; connecting a hook 42 of a sling 41 provided on a wall of the LED lamp 4 to a hook holder 11 of the housing 1; finishing electrical connections as required; and pushing the LED lamp 4 into the first mounting room 31, the LED lamp 4 is thus positioned when it is attracted to the magnetic body 5 located in the mounting element 3.

The above-mentioned embodiments are the preferred embodiments of the present invention. Variations and modifications are allowed within the scope of the invention. Those skilled in the art will appreciate that the features described above can be combined in various ways to form multiple variations of the invention. As a result, such variations fall within the scope of the protection to the present invention.

What is claimed is:

1. A recessed lighting fixture comprising a housing (1), wherein an edge at an open end of the housing (1) extends horizontally and outwardly and then bends perpendicularly and downwardly to form a first chamber (2) having a rectangular cross section, a bottom of the perpendicular edge extends horizontally and outwardly and then bends perpendicularly and upwardly to form a tray (21) having a rectangular cross section, a mounting element (3) is fixed to a bottom of the first chamber (2), the mounting element (3) has a magnetic body (5) for attracting and positioning the LED lamp (4);

wherein the mounting element (3) is consisted of:

an U-shaped body (32);

a vertical wall (33), the vertical wall (33) running parallel with a side wall (321) of the U-shaped body (32) and being connected with the side wall (321) through a horizontal wall (36); and a cantilever (34), the cantilever (34) being formed at a bottom end of the vertical wall (33) and consisted of an outwardly-extending portion and an inwardly-extending potion, wherein the outwardly-extending portion of the cantilever (34) covers a portion of a bottom surface of the tray (21), the inwardly-extending potion of the cantilever (34) runs parallel with a bottom wall of the U-shaped body (32) and has a plurality of upwardly-and-perpendicularly positioned gripper jaws (341);

a first mounting room (31) for receiving an LED lamp (4) is formed between the bottom wall of the U-shaped body (32) and the gripper jaws (341); and a second mounting room (35) for receiving an aluminum substrate (8) having LED bulbs (81) thereon is a space defined among the vertical wall (33), the horizontal wall (36) and the inwardly-extending potion of the cantilever (34).

2. The recessed lighting fixture of claim 1, wherein an inner wall of the housing (1) is provided with a hook holder (11), which is corresponding to a hook (42) provided at an end of a sling (41) provided on a wall of the LED lamp (4); the LED lamp (4) is connected to the housing (1) through the hook (42) being caught in the hook holder (11).

3. The recessed lighting fixture of claim 1, wherein the U-shaped body (32) has the magnetic body (5) therein.

4. A method of replacing fluorescent lamps with LED lamps in the recessed lighting fixture of claim 1, comprising:

removing reflector panels (6) and fluorescent lamps (7) from the recessed lighting fixture;

connecting a hook (42) of a sling (41) provided on a wall of the LED lamp (4) to a hook holder (11) of the housing (1);

finishing electrical connections of the LED lamp; and pushing the LED lamp (4) into the first mounting room (31), the LED lamp (4) is thus positioned when it is attracted to the magnetic body (5) located in the mounting element (3).

* * * * *